US007066743B2

(12) United States Patent
Hu et al.

(10) Patent No.: US 7,066,743 B2
(45) Date of Patent: Jun. 27, 2006

(54) ELECTRICAL CONNECTOR WITH SPACER

(75) Inventors: Bingbo Hu, Kunsan (CN); Renzhi Li, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/913,090

(22) Filed: Aug. 6, 2004

(65) Prior Publication Data

US 2005/0032427 A1 Feb. 10, 2005

(30) Foreign Application Priority Data

Aug. 6, 2003 (TW) ..... 92214291 U

(51) Int. Cl.
*H01R 12/00* (2006.01)

(52) U.S. Cl. ..... 439/83

(58) Field of Classification Search ..... 439/74, 439/83, 660, 637

See application file for complete search history.

(56) References Cited

U.S. PATENT DOCUMENTS

| | | | | |
|---|---|---|---|---|
| 3,101,231 | A * | 8/1963 | Klostermann | 439/660 |
| 5,137,454 | A * | 8/1992 | Baechtle | 439/62 |
| 5,470,261 | A * | 11/1995 | Embo et al. | 439/752 |
| 5,915,976 | A | 6/1999 | McHugh | |
| 6,033,236 | A | 3/2000 | McHugh et al. | |
| 6,179,626 | B1 * | 1/2001 | Wu | 439/74 |
| 6,929,510 | B1 * | 8/2005 | Pan | 439/607 |

* cited by examiner

*Primary Examiner*—Neil Abrams
(74) *Attorney, Agent, or Firm*—Wei Te Chung

(57) ABSTRACT

An electrical connector (1) includes a dielectric housing (10), a number of terminals (20) received in the dielectric housing (20) and a spacer (30). The dielectric housing includes a pair of side walls (13) and a cavity (17) extending from a mounting surface (12 thereof and located between the side walls. Each terminal (20) includes a tail portion (26) exposed in the cavity. The spacer is received in the cavity and comprises a pair of opposite pressing portions (34). The tail portions (26) of the terminals are sandwiched between the side walls and the pressing portions.

10 Claims, 4 Drawing Sheets

ELECTRICAL CONNECTOR WITH SPACER

BACKGROUND OF THE INVENTION

1. Field of the Invention

The present invention relates to an electrical connector, and particularly to an electrical connector having a spacer for reliably positioning terminals in a dielectric housing thereof.

2. Description of Related Art

Board-to-Board connector assembly generally includes two matable connectors respectively mounted on two parallelly spaced printed circuit boards (PCB) to electrically connect these two PCBs for signal transmission therebetween. In some special applications, a large distance is required between the two spaced PCBs. A high profile board-to-board connector is accordingly developed to satisfy this requirement. However, the high profile connector may cause a variety of problems. For instance, as the complexity of a high profile housing of the high profile connector increases, the difficulty of manufacturing the high profile housing increases. Another problem is that the terminals received in the high profile housing have elongated mounting potions which are apt to warp during assembly and transportation of the connector, thereby not ensuring coplanarity of solder portions of the terminals and resulting in the terminals being difficult to accurately surface mounting onto the PCB.

Hence, a high profile board-to-board connector with terminals reliably positioned is desired to overcome the disadvantage of the prior art.

SUMMARY OF THE INVENTION

An object of the present invention is to provide an electrical connector with a spacer for facilitating positioning terminals of the connector.

To achieve the above object, an electrical connector includes a dielectric housing, a plurality of terminals received in the dielectric housing and a spacer. The dielectric housing comprises a pair of opposite side walls, and a cavity extending from a mounting surface thereof and located between the side walls. Each terminal includes a tail portion exposed in the cavity. The spacer is received in the cavity and comprises a pair of opposite pressing portions. The pressing portions press the tail portions of the terminals on the pressing portions.

Other objects, advantages and novel features of the invention will become more apparent from the following detailed description when taken in conjunction with the accompanying drawings.

DETAILED DESCRIPTION OF THE PREFERRED EMBODIMENT

Figure 1:
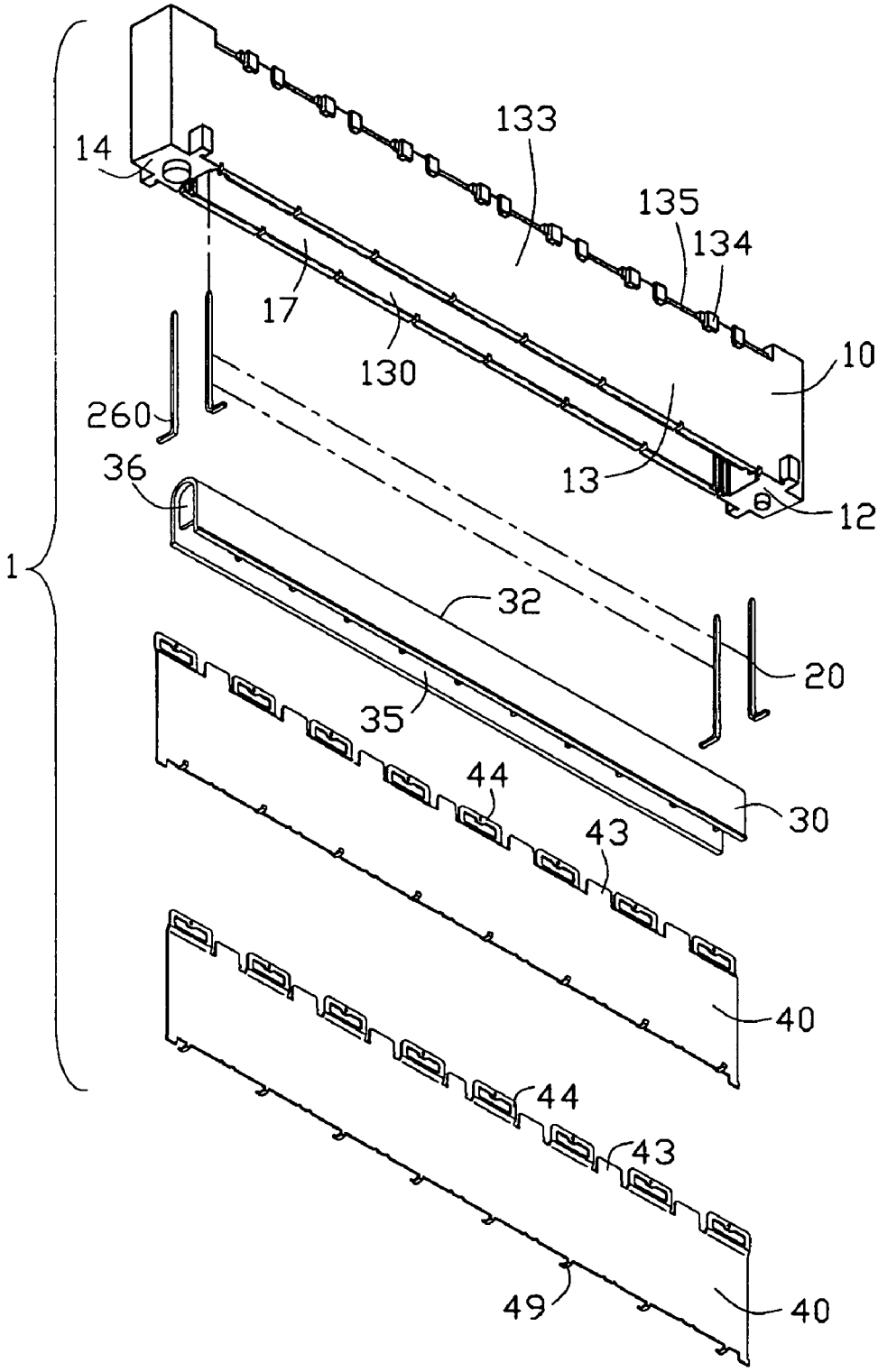
FIG. 1 is an exploded perspective view of an electrical connector in accordance with the present invention.
Figure 2:
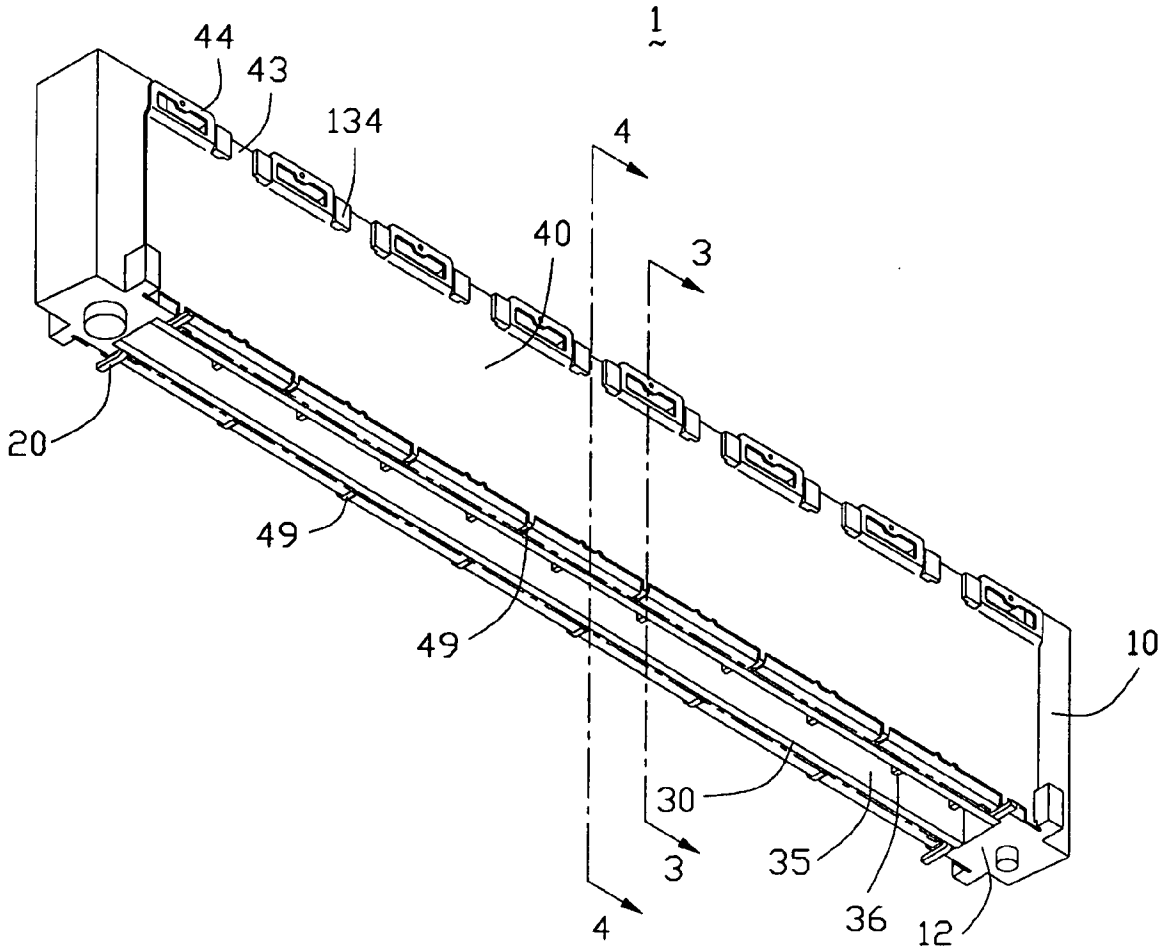
FIG. 2 is an assembled perspective view of the connector shown in FIG. 1.

Referring to FIGS. 1 and 2, an electrical connector 1 in accordance with the present invention comprises an elongate dielectric housing 10, a plurality of terminals 20 received in the dielectric housing 10, a spacer 30 adapted for positioning the terminals 20 and a pair of shield plates 40 enclosing the dielectric housing 10.

Figure 3:
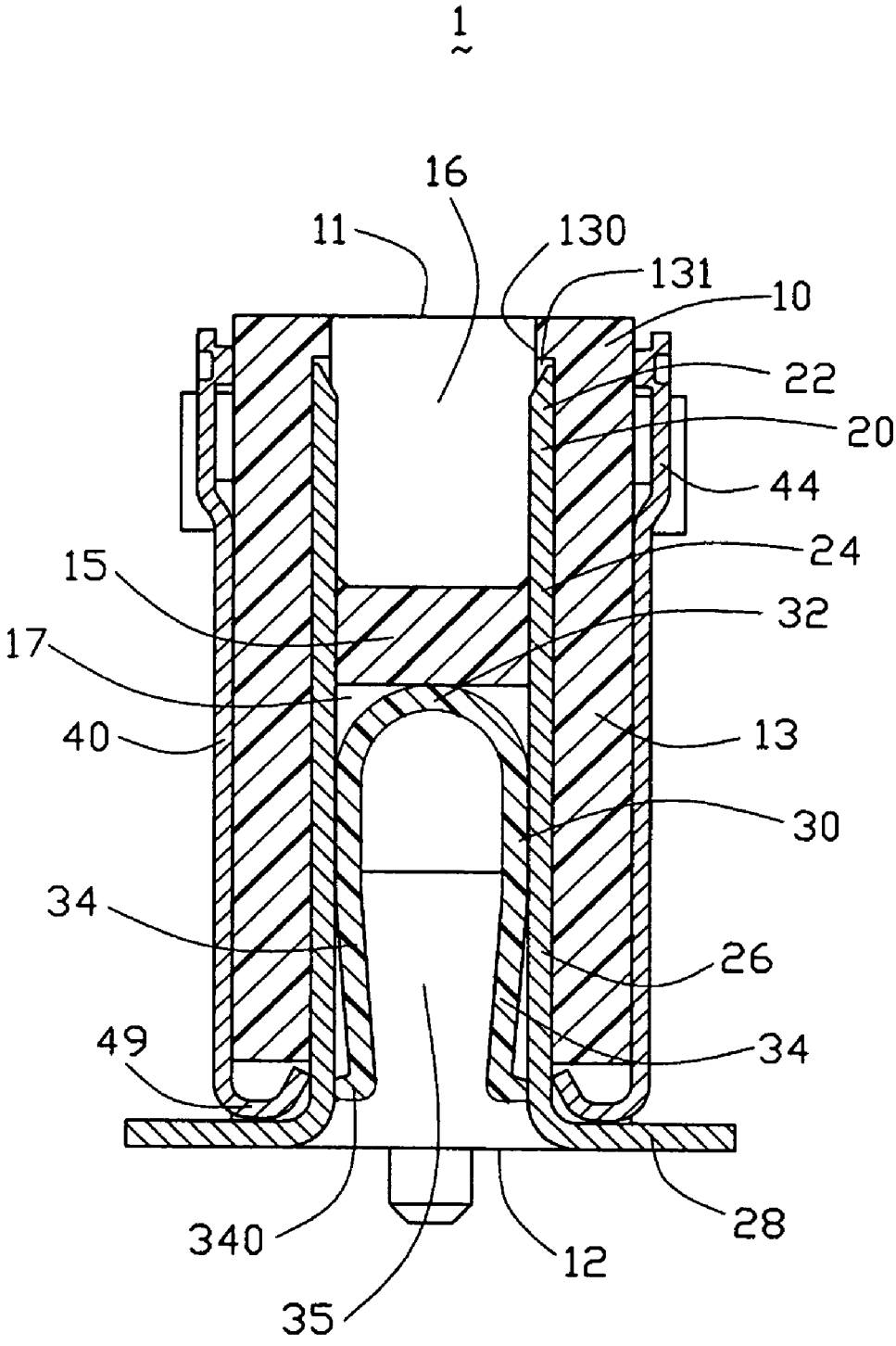
FIG. 3 is a cross-sectional view of the connector taken along line 3—3 of FIG. 2.

Referring to FIGS. 1 and 3, the dielectric housing 10 has a mating surface 11 and a mounting surface 12 opposite to the mating surface 11. Opposite elongate side walls 13 and opposite end walls 14 extend between the mating surface 11 and the mounting surface 12. The dielectric housing 10 defines a mating space 16 extending from the mating surface 11 toward the mounting surface 12 and a cavity 17 extending from the mounting surface 12 toward the mating surface 11. A clapboard 15 is formed between the mating space 16 and the cavity 17 and interconnects with the side wall 13 and the end walls 14. Each side wall 13 defines a plurality of passageways 131 in an inner face 130 thereof. Each passageway 131 comprises an upper section (not label) adjacent to the mating surface 11 and communicating with the mating space 16, an intermediate section (not label) passing through a joint of the side wall 13 and the clapboard 15, and a lower section (not label) adjacent to the mounting surface 12 and communicating with the cavity 17. The side wall 13 has a plurality of pairs of protrusions 134 and a plurality of cutouts 135 altenatively arranged with pairs of protrusions 134 on an outer face 133 thereof.

Figure 4:
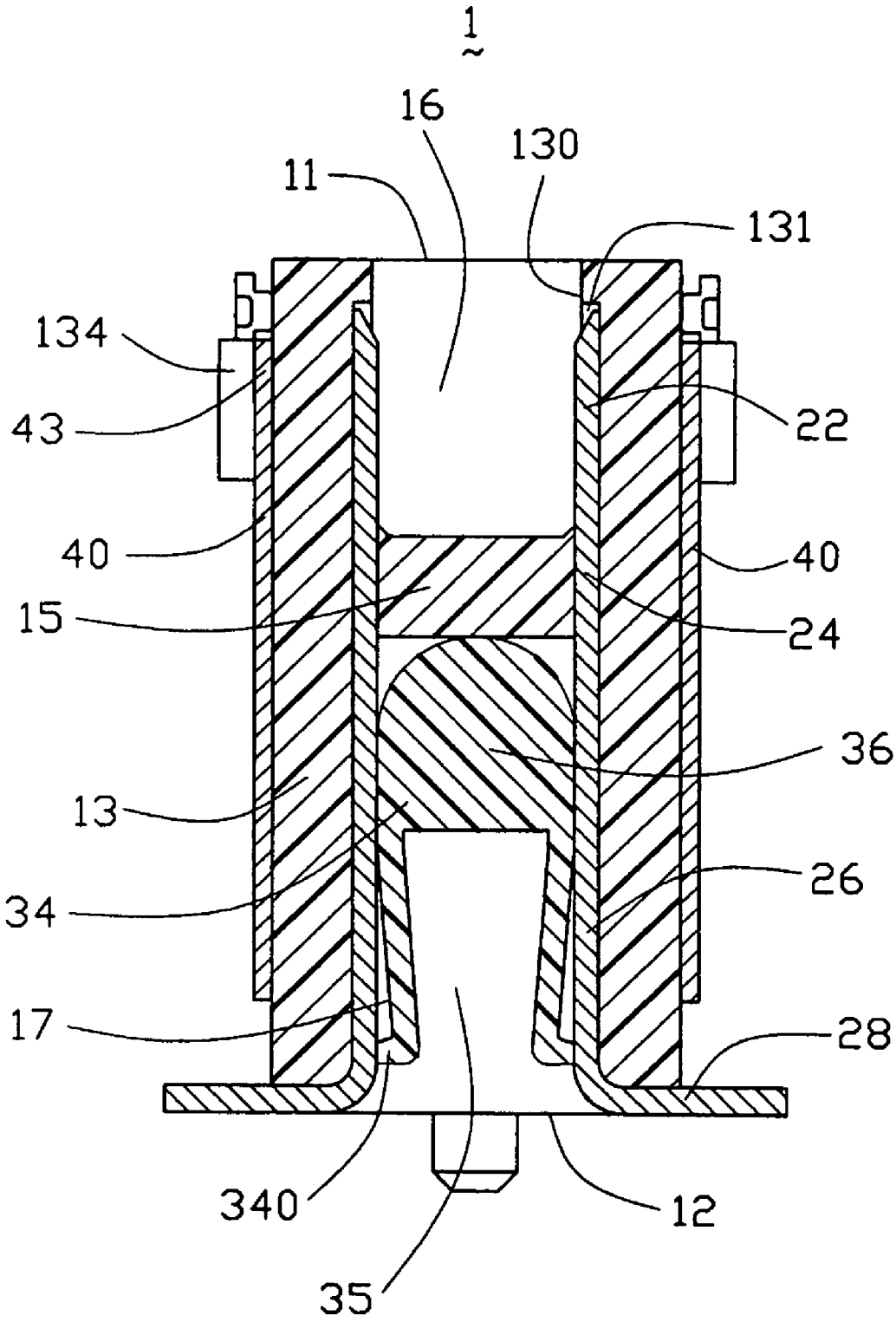
FIG. 4 is a cross-sectional view of the connector taken along line 4—4 of FIG. 2.

Referring to FIGS. 1, 3 and 4, each terminal 20 comprises a contact portion 22 received in the upper section of the passageway 131, a retaining portion 24 extending from the contact portion 22 and retained in the intermediate section of the passageway 131, a tail portion 26 extending from the retaining portion 24 and a solder portion 28 perpendicularly extending from the tail portion 26 for being surface mounted onto a printed circuit board (not shown). The tail portion 26 is formed with a pair of opposite barbs 260 adjacent to the solder portion 28 and is received in the lower section of the passageway 131 with the barbs 260 interferentially fitted in the passageway 131.

The shield plates 40 are attached to the outer faces 133 of the side walls 13 for shielding purpose. Each shield plate 40 comprises a plurality of retention blades 43 extending from an upper edge thereof for cooperating with corresponding pairs of protrusions 134 of the side wall 13 to secure the shield plates 40 to the dielectric housing 10. The shield plate 40 further comprises a plurality of grounding tangs 44 each positioned between every adjacent two retention blades 43 for facing to corresponding cutout 135 which is adapted to receive a grounding contact of a complementary connector (not shown). A plurality of grounding pins 49 extends curvedly and inwardly from a bottom edge of the shield plate 40 for electrically and mechanically connecting with the soldering tail 28 of predetermined terminals 20.

The desired position of the tail portions 26 relative to the housing 10 may not be reliable only by means of the barbs 260 due to an elongate suspending nature of the tail portion 26. The electrical connector 1 in accordance with the present invention is provided with a spacer 30 for securely positioning the terminal 20. As can be understood, the securely positioning applies whether the barbs 260 are formed on the tail portion 26. Referring to FIGS. 1, 3 and 4, the dimension of the spacer 30 is designed according to the dimension of the cavity 17. The spacer 30 has an elongated body with a U-shaped cross section. The spacer 30 comprises an arced intermediate portion 32 and a pair of larerally-spaced pressing portions 34 approximately parallelly extending downwardly from opposite ends of the intermediate portion 32 to define a chamber 35 therebetween. Each pressing portion 34 is formed with a projection 340 extending outwardly at a free end thereof. The spacer 30 is formed with a plurality of laterally extending strengthened ribs 36 connecting with the intermediate portion 32 and the pressing portion 34 for increasing the strength of the spacer 30. The ribs 36 are parallelly arranged along a lengthwise direction of the spacer 30 and are spaced from each other. The spacer 30 is assembled into the cavity 17 of the housing 10 with the intermediate portion 32 positioned adjacent to the clapboard 15. The tail portions 26 of the terminals 20 are tightly sandwiched between the projections 340 of the pressing portions 34 and the side walls 13 due to resilient deflection of the pressing portions 34. The terminals 20 are thus securely retained in the housing 10 thereby ensuring coplanarity of the solder portions 28 of the terminals 20. Contemporarily, the spacer 30 is interferentially retained in the cavity 17 of the dielectric housing 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing comprising a mounting surface, a pair of opposite side walls and a cavity in the mounting surface between the side walls;

a plurality of terminals received in the dielectric housing and each comprising a tail portion exposed to the cavity; and a spacer received in the cavity and comprising an arced intermediate portion having opposite ends and a pair of pressing portions respectively extending from the opposite ends of the intermediate portion, the pressing portions tightly pressing the tail portions of the terminals on the side walls.

2. The electrical connector as claimed in claim 1, wherein the spacer defines a chamber between the intermediate portion and the pressing portion.

3. The electrical connector as claimed in claim 2, wherein the pressing portion are deflected toward chamber.

4. The electrical connector as claimed in claim 1, wherein the spacer is formed with a plurality of spaced strengthened ribs along a lengthwise direction thereof.

5. The electrical connector as claimed in claim 1, wherein the pressing portion is formed with a projection extending outwardly to tightly abut against the tail portions of the terminals.

6. The electrical connector as claimed in claim 1, wherein the housing has a clapboard laterally interconnecting said side walls for forming said mounting space and a mating space opposite to the mounting space, and wherein the terminal comprises a contact portion exposed in the mating space for mating with a contact of a complementary connector.

7. The electrical connector as claimed in claim 6, wherein the dielectric housing defines a plurality of passageways communicating with the mating space and the cavity and receiving corresponding terminals therein.

8. The electrical connector as claimed in claim 1, further comprising a pair of shield plates covering opposite side faces of the dielectric housing.

9. An electrical connector comprising:

a dielectric housing comprising a mounting surface, and a cavity above the mounting surface, at least one side wall located beside said cavity;

a plurality of terminals receiving in the dielectric housing and each comprising a tail portion located on an interior surface of the side wall and exposed to the cavity; and a spacer extending along a longitudinal direction of the housing and upwardly inserted into and received in the cavity and comprising a pressing portion, the pressing portions laterally pressing the tail portions of the terminals; wherein the spacer is essentially of a hollow type while with a plurality of reinforcement ribs therein.

10. An electrical connector comprising:

a dielectric housing comprising a mounting face, and a cavity above the mounting face, at least one wall located beside said cavity;

a plurality of terminals received in the dielectric housing and each comprising a tail portion located on an interior surface of the wall and exposed to the cavity; and a spacer extending along a longitudinal direction of the housing and upwardly inserted into and received in the cavity and comprising a pressing portion, the pressing portions laterally pressing the tail portions of the terminals; wherein the spacer is essentially of the hollow type while with a plurality of reinforcement ribs therein, and is inserted into the cavity after the tail portion are retained on the interior surface.

* * * * *